US011472667B2

(12) United States Patent
Hovi et al.

(10) Patent No.: US 11,472,667 B2
(45) Date of Patent: Oct. 18, 2022

(54) ELECTRONIC INFORMATION PLATE OF AN ELEVATOR COMPONENT

(71) Applicant: KONE Corporation, Helsinki (FI)

(72) Inventors: Antti Hovi, Helsinki (FI); Ari Kattainen, Helsinki (FI)

(73) Assignee: KONE CORPORATION, Helsinki (FI)

( * ) Notice: Subject to any disclaimer, the term of this patent is extended or adjusted under 35 U.S.C. 154(b) by 911 days.

(21) Appl. No.: 16/281,916

(22) Filed: Feb. 21, 2019

(65) Prior Publication Data

US 2019/0177115 A1 Jun. 13, 2019

Related U.S. Application Data

(63) Continuation of application No. PCT/FI2016/050680, filed on Sep. 29, 2016.

(51) Int. Cl.

| | |
|---|---|
| ***B66B 5/00*** | (2006.01) |
| ***B66B 1/14*** | (2006.01) |
| ***B66B 1/34*** | (2006.01) |
| ***B66B 3/00*** | (2006.01) |
| ***B66B 7/12*** | (2006.01) |

(52) U.S. Cl.

CPC ..... *B66B 5/0025* (2013.01); *B66B 1/14* (2013.01); *B66B 1/3446* (2013.01); *B66B 3/002* (2013.01); *B66B 5/00* (2013.01); *B66B 5/0037* (2013.01); *B66B 7/1215* (2013.01)

(58) Field of Classification Search

CPC ..... B66B 5/0025; B66B 1/14; B66B 1/3446; B66B 3/002; B66B 5/00; B66B 5/0037; B66B 7/1215; B66B 7/1207; B66B 5/0087; B66B 7/06

See application file for complete search history.

(56) References Cited

U.S. PATENT DOCUMENTS

| | | | | |
|---|---|---|---|---|
| 7,711,565 | B1 | 5/2010 | Gazdzinski | |
| 9,695,015 | B1 * | 7/2017 | Marinelli | B66B 13/165 |
| 2018/0229970 | A1 * | 8/2018 | Lehtinen | D07B 1/162 |
| 2019/0071282 | A1 * | 3/2019 | Zapf | B66B 7/1215 |
| 2020/0087111 | A1 * | 3/2020 | Wos | B66B 1/3461 |

(Continued)

FOREIGN PATENT DOCUMENTS

| | | | |
|---|---|---|---|
| CN | 101535162 | A | 9/2009 |
| CN | 201592932 | U | 9/2010 |
| CN | 102761569 | B | 10/2014 |

(Continued)

OTHER PUBLICATIONS

First Office Action issued in corresponding Chinese Application No. 201680089215.2 dated Apr. 3, 2020.

*Primary Examiner* — Jeffrey Donels

(74) *Attorney, Agent, or Firm* — Birch, Stewart, Kolasch & Birch, LLP

(57) ABSTRACT

Elevator components can be equipped with an electronic information plate. The electronic information plate are associated with a particular electronic information plate that can store different properties of the associated component. The content of each electronic information plate is read manually or automatically and transmitted to a controller. The controller analyzes the received content and launches a predetermined action if the content indicates a possible mistake or a fraud.

15 Claims, 2 Drawing Sheets

(56) References Cited

U.S. PATENT DOCUMENTS

| | | | | |
|---|---|---|---|---|
| 2020/0109029 | A1* | 4/2020 | Pahlke | B66B 5/0087 |
| 2020/0207578 | A1* | 7/2020 | Liaskas | B66B 25/006 |

FOREIGN PATENT DOCUMENTS

| | | | |
|---|---|---|---|
| JP | 2007-50999 | A | 3/2007 |
| KR | 10-0894957 | B1 | 4/2009 |
| WO | WO 2013/110854 | A1 | 8/2013 |

* cited by examiner

ELECTRONIC INFORMATION PLATE OF AN ELEVATOR COMPONENT

DESCRIPTION OF BACKGROUND

Cross Reference to Related Applications

This application is a Continuation of PCT International Application No. PCT/FI2016/050680, filed on Sep. 29, 2016, which is hereby expressly incorporated by reference into the present application.

The following description relates to elevators and particularly to electronic information plates identifying a particular elevator component and the properties of the elevator component.

Elevators are mechanical devices and include a plurality of components that wear when the elevator is used. Some of these components have a predetermined life expectancy. The life expectancy can be counted, for example, in years or number of operation cycles. The life expectancy is computed using appropriate safety margins so that the component in question will be replaced before it is dangerous to use.

Examples of such components include belts and ropes that are used in elevators for various purposes. Conventionally the elevator controller comprises a counter that counts the operation cycles for a particular belt or rope. When the counter indicates a need for new belt or rope a technician will be called and the belt or rope will be replaced. The counter is typically reset after the replacement. The counter is reset in a manner that it will correspond with the life expectancy of the replacement component. The new life expectancy does not need to be the same with the earlier one because of different properties. Resetting the counter may involve a use of a passcode given by the elevator manufacturer or operator.

The approach disclosed above provides an indication about the moment when at least one component needs to be changed. However, it does not provide a possibility to verify if the technician actually replaced the component or if the replacement component was of same quality as the original one. Thus, it is possible that the counter does not indicate a number that is in accordance with the quality requirement of the elevator manufacturer. Furthermore, if the technician only resets the counter without replacing the component in question a risk of safety related problem is increased.

Recently regulators and legislators have increased the requirements with regard the traceability of elevator components and particularly safety related. It is desired that the whole lifecycle of a safety related component is documented in more detail as earlier. Furthermore it is desired that the accuracy and integrity of the documentation can be verified.

SUMMARY

An electronic information plate for an elevator component is disclosed. Elevator components can be equipped with an electronic information plate. The electronic information plate are associated with a particular electronic information plate that can store different properties of the associated component. The content of each electronic information plate is read manually or automatically and transmitted to a controller. The controller analyzes the received content and launches a predetermined action if the content indicates a possible mistake or a fraud.

In an embodiment a method for determining safety related properties of at least one component of an elevator is disclosed. The method comprises reading an electronic information plate, wherein said electronic information plate is configured to store safety related information of at least one component of said elevator; transmitting the content of said read electronic information plate into an elevator controller; comparing said content with data associated with said elevator and detecting as a result of said comparison if any of said at least one component has exceeded a predetermined life cycle. In an embodiment said predetermined life cycle is counted in number of operation cycles. In another embodiment said predetermined life cycle is counted as a time interval. In a further embodiment both counts are used. In a further embodiment the electronic information plate is read by using a reader fixed into an elevator car. In another embodiment the content is transmitted by using a transmitter of an elevator car. In a further embodiment the method further comprises receiving said content at said elevator controller and performing said comparing at said controller. In another embodiment at least one component of an elevator is a mechanical non-electronic component or at least partially non-electronic component. In a further embodiment at least portion of said data associated with said elevator is stored into at least one of the following: said electronic information plate, server, cloud or database. This information may include, for example, the values of different counters or other properties that are relevant with the respective component.

In an embodiment an elevator is disclosed. The elevator comprises at least one component; at least one electronic information plate associated with at least one component, wherein said at least one electronic information plate is configured to store safety related information with regard said associated at least one component.

In another embodiment the further comprises a reader device for reading the content of said at least one electronic information plate. In a further embodiment the elevator further comprises a transmitter for transmitting said content. In another embodiment the elevator comprises a controller and said controller is configured to receive said transmitted content. In another embodiment the controller is configured to compare said content with data associated with said elevator.

In a further embodiment the controller is configured to detect as a result of said comparison if any of said at least one component has exceeded a predetermined life cycle. In a further embodiment the at least one electronic information plate comprises a security circuit. In another embodiment the at least on electronic information plate is associated with at least one non-electronical component. In a further embodiment the controller is configured to store at least portion of said data associated with said elevator into at least one of the following: said electronic information plate, server, cloud or database.

In an embodiment an electronic information plate is disclosed. The electronic information plate is associated with an elevator component. The electronic information plate comprises at least one memory, wherein said at least one memory comprises information regarding at least one property of an elevator component; at least one electricity source, wherein said electricity source is configured to receive electricity by using electromagnetic induction; at least one communication interface, wherein said communication interface is configured to transmit said at least one property of an elevator component as a response to read request; and at least one security circuit, wherein in said security circuit is configured to provide information necessary to verify the authenticity of said electronic information plate.

The benefits of described embodiments include better control and monitoring of elevator components and particularly safety related elevator components. Additional electronic information plate may be associated with a particular component or maintenance task. The correct performing of the required component change or task can be traced and overuse of elevator components can be prevented. In automated online embodiments it is possible to get real time or almost real time information which makes detecting suspicious situations easier. In manual embodiments, wherein a maintenance person reads electronic information plates by using a portable reader device suspicious situations may be detected when the maintenance person is already at the site. Thus, it is possible to detect possible mistakes or frauds even in components that otherwise would not had been inspected on that visit. A further benefit of an electronic information plate is that it improves traceability of elevator components as the use of components can be reliability stored into a centrally managed database.

BRIEF DESCRIPTION OF THE DRAWINGS

The accompanying drawings, which are included to provide a further understanding of the electronic information plate and constitute a part of this specification, illustrate embodiments and together with the description help to explain the principles of the electronic information plate. In the drawings.

DETAILED DESCRIPTION

Reference will now be made in detail to the embodiments, examples of which are illustrated in the accompanying drawings.

In the following an electronic information plate for components in an elevator. Examples of such components are suspension elements, drive belts, ropes, buffers and similar mechanical and typically non-electronic components. Ropes may be, for example hoisting ropes or overspeed governor ropes. The components mentioned above are just examples and the electronic information plate disclosed can be used also with other components. Typically the components are non-electronical and thus, there is no possibility to implement electronic information plate within the electronic circuits of the component. Components may also be partially electronic so that they include electronic features that are not related to monitoring the life expectancy of the component.

The electronic information plate used is an electronic device that can store data. Typically the data is stored into non-volatile memory. The data can be read wirelessly by using a reader device. In some implementations the data may be stored wirelessly by using the same or another reader. The electronic information plate may be able to perform simple computational tasks. The electronic information plate is typically passive and does not require power source. The operating power is received from the reader device by means of electromagnetic induction. An example of suitable device is a passive RFID-tag. RFID tags are small in size and can be read at a distance. Other similar tags may also be used.

The information stored may include one or more of the following: a reset code for a counter, material number, serial number, date of manufacturing, factory identification, performance parameters of the component, life time parameters, type examination certificate, declaration of conformity or similar.

In the following an embodiment using a reader device permanently fixed to an elevator car is used, however, it is not necessary. One or more information plates may be attached to an elevator in a manner that the maintenance person can read the contents by using a portable reader device. Furthermore, it is possible to install the reader device to the shaft side and read electronic information plates whenever the elevator car comprising electronic information plates passes by. The reader device may send the read data further to a database, server, cloud service or similar.

Figure 1A:
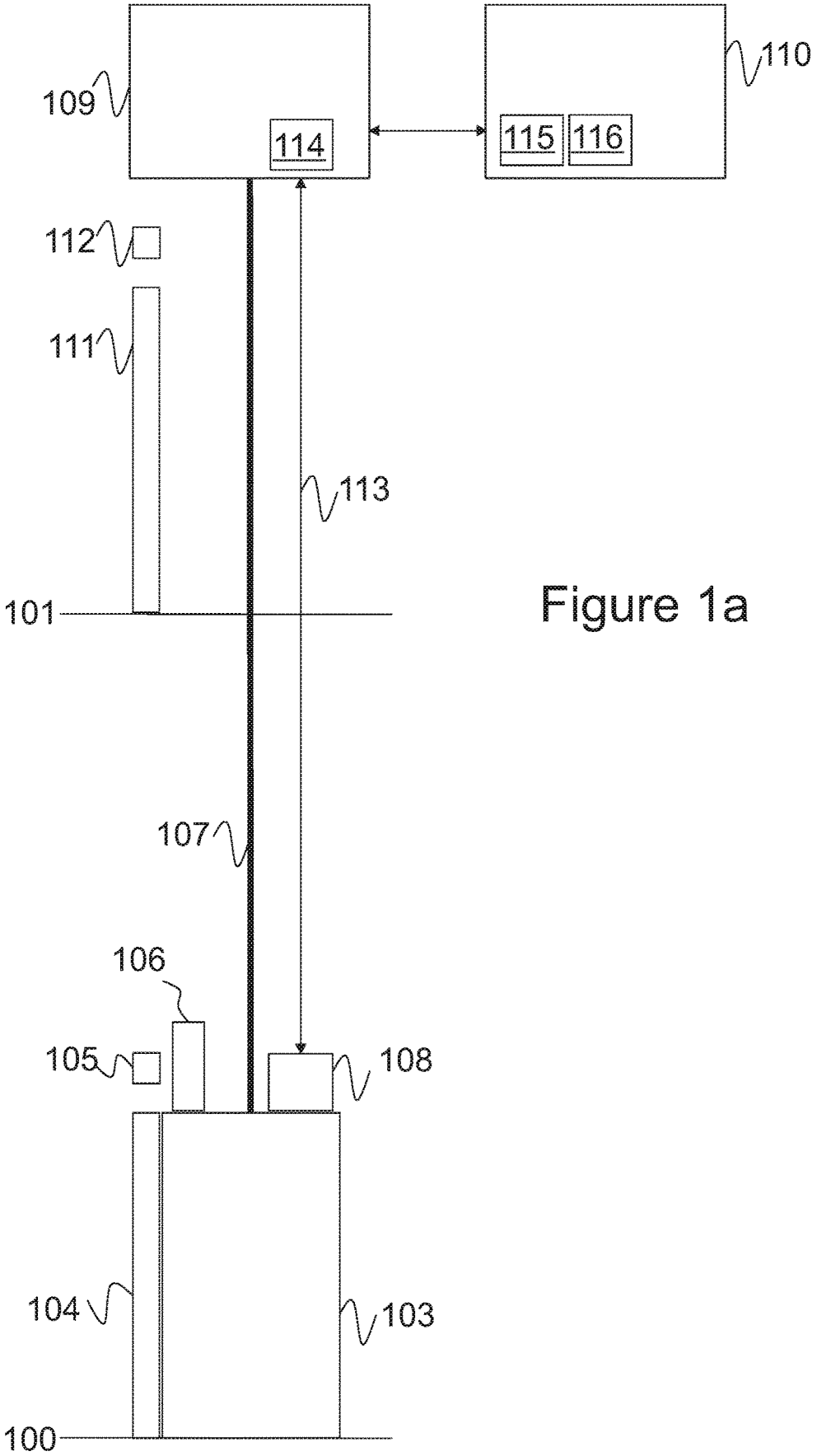
FIG. 1*a* is a block diagram of an example embodiment of an arrangement using the present electronic information plate.

In FIG. 1*a* a block diagram of an embodiment of an elevator comprising at least one component with an electronic information plate is disclosed. In FIG. 1*a* an elevator car 103 disclosed. The elevator car 103 can stop in a first floor 100 and a second floor 101. The floors may be any floor in a building and not necessarily the first and second floor of the building. The first floor 100 may be, for example, garage and the second floor 101 the ground level. In front of the elevator car 103 a landing door 104 can be seen. In the embodiment of FIG. 1*a* an electronic information plate 105 is located above the landing door and a reader device 106 is located on the top of the elevator car. Thus, the electronic information plate is easy to read when the elevator car 103 stops behind the door 104.

In FIG. 1*a* a similar arrangement can be seen at the second flood 101, wherein an electronic information plate 112 is also above landing door 111. This arrangement is, however, only an example. The information plate may be read even if the elevator does not stop next to it. Another option is to put electronic information plates into an elevator car so that they are easy to read by a maintenance person but cannot be accessed by the public.

In FIG. 1*a* rope 107 is a hoisting rope and used for operating the elevator. The elevator further comprises a data communication connection 113 that may be implemented by using wireless transmitter or a travelling cable. In the example of FIG. 1*a* a wireless transmitter 108 is configured to communicate with the counterpart 114, which in this embodiment is located together with the hoisting arrangement 109. The wireless transmitter 108 is further configured to communicate with the reader device 106. Thus, when the reader device reads an electronic information plate the information is first passed to a wireless transmitter 108 and then to control device 110 via transceiver 114. The connection between transceiver 114 and controller 110 may be any known data communication connections, such as a local area network or similar.

Controller 110 receives the contents of each read electronic information plate. It is possible to configure the transmissions in a manner that, for example, that the content of each electronic information plate is transmitted once in a day or every time when the reader is in the vicinity of the electronic information plate and can read the electronic information plate. As the information does not typically change frequently also longer intervals may be used.

The transmission is received at the controller 110 and processed by at least one processor 115 and stored into at least one memory 116. The at least one memory comprises 116 a database or similar that can be accessed also by other devices.

Correspondingly, at least one memory 116 may be completely or in part outside the controller 110 and the controller only accesses the memory 116 that is located in a different location, such as a server or cloud service.

The electronic information plate as in the example of FIG. 1*a* includes a security circuit or other similar functionality. The purpose of the security circuit is to prevent falsification of electronic information plates. Thus, when the electronic information plate is manufactured by, for example, the rope manufacturer, it is not possible to copy or reuse the information plate. Also counterfeit information plates can be prevented. Suitable security solutions are available, for example, for RFID-tags. Thus, when a component manufacturer, such as rope manufacturer, always provides a tag that is associated with a particular component the identity of the component can be verified. The manufacturer may produce replacement plate in case of malfunction, however, in such case it is possible to cancel the old information plate. If the cancelled information plate is reused later the system receiving the information detects this and can inform appropriate parties. Thus, it is not possible to use electronic information name plates other than those that are manufactured by component manufacturers.

Figure 1B:
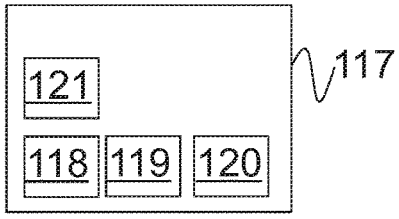
FIG. 1*b* is a block diagram of an example embodiment of the present electronic information plate.

FIG. 1*b* discloses an example embodiment of an electronic information plate 117 for elevator components. The electronic information plate 117 comprises at least one memory 118. The memory comprises necessary information regarding the elevator component being monitored, for example, reset codes, counter values, manufacturing date and similar. It is possible that there are memories of different type. For example, most of the information can be stored into read only memory to which the information has been stored by the elevator component manufacturer who provides typically also the electronic information plates. For example, with regard installation date information it may be beneficial that the information may be written once at the installation site. Thus, this information is then stored permanently and cannot be rewritten again. In more sophisticated versions the information may be rewritten, however, this implementation is more complicated and may require management of access rights. This kind of arrangement may be beneficial, for example, for storing the last inspection date. It is possible to have all kinds of memory on the same electronic information plate.

Figure 2:
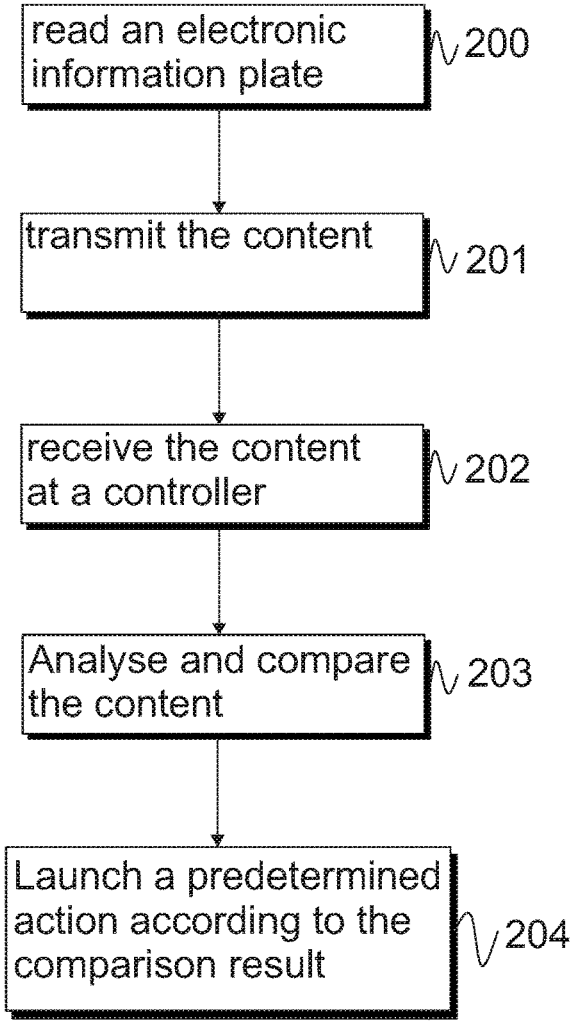
FIG. 2 is a flow chart of a method according to an example embodiment of the present electronic information plate.

The electronic information plate 117 further comprises at electricity source 119 and at least one communication interface 120. The electricity source 119 may be an electricity source that is powered by the reader device using electromagnetic induction. The reader device communicates with at least one communication interface. The electronic information plate 117 further comprises a security circuit 121. The security circuit is provided for determining the authenticity of the electronica information plate 117. The security circuit may be implemented several ways, for example, by using common cryptography and solutions that are available, for example, for RFID-tags. In FIG. 2 a method according an example embodiment is disclosed. The method is initiated by using a reader for reading the content of an electronic information plate, step 200. In the example of FIG. 2 the reader is configured to read one electronic information plate at time. However, one elevator may comprise more than one electronic information plate. In such case the reader may read one electronic information plate at time or use a method for reading multiple electronic information plates simultaneously. Typically the reading process takes only short time and it is possible to read multiple electronic information plates also sequentially.

The reader is connected to a transmitter using wired or wireless connection. The transmitter then transmits the read content, step 201. The transmission may be done by using a wireless transmitter or a travelling cable. The transmitter may be an independent transmitter using mobile communication networks, Wi-Fi or similar. However, it is also possible to use the transmission channels that are dedicated particularly for that elevator car. When the transmission is done over a public network the communication may be encrypted.

The transmission is received at a controller, step 202. The transmission needs not to be a direct transmission but may involve any number of network elements in between. Thus, using an ordinary wireless internet connection is acceptable provided that the controller is able to receive the transmission.

The relevant information is then extracted from the transmission. The extracted information is then analyzed and compared with corresponding information in the controller database, step 203. For example, it is possible to compare if the content of the tag is what it is supposed to be. For example, each of the electronic information plates may have a serial number which is associated with the location of the elevator. If the serial number does not match with assumed location there may be a mistake or fraud.

In case of suspected mistake or fraud it is possible to launch a predetermined action, step 204. This may be, for example, assigning a task to a maintenance person to check the issue during the next inspection. Because of the need to check the next inspection may be rescheduled. It is possible to configure the system in a manner that the predetermined action is not taken when the issue is noticed first time but wait for a second confirmation so that reading errors can be eliminated and unnecessary work is avoided.

In the embodiment described above an electronic information plate is used. The content and design of the electronic information plate varies depending on the application. For example, the electronic information plate may be a passive read only RFID tag to which the content is stored by the provider and it cannot be rewritten. The content stored may be chosen by the elevator provider. However, it is possible to use also more sophisticated electronic information plates that can also be rewritten when appropriate writing access rights are taken appropriately care of.

In rewriting embodiment access rights for rewriting may be used and a hash-sum may be produced for detecting unauthorized changes in the content. Furthermore, the content to be written may be received from a content controlling entity so that a hash-sum corresponding with the content can be produced and provided to the controller. The content may be specifically assigned for a certain component and include a unique serial number. Thus, if the electronic information plate is copied it is possible to detect that the same serial number is used in multiple places. The content of the may include any data relevant for the elevator component in question. For example, if a special reset code needs to be applied it is possible to provide the code in the electronic information plate.

In rewriting embodiment the electronic information plate may be associated also with two or more components so that the memory of the electronic information plate is configured to store one or more software implemented information plates. These software implemented information plates may be completely independent and are processed independently. The reader device may be configured to read them one at time or as a package that will be extracted later.

In a further embodiment the use of the electronic information plate is integrated to the system in a manner that when the contents of the electronic information plate are used in any way the controller may make changes to the properties of the elevator. For example, when the electronic information plate comprises a reset code for resetting a counter, the controller detects the use of reset code and changes it so that the code stored in the electronic information plate cannot be used twice.

In further embodiments some of the properties of the elevator may be stored for future review. For example, the value of the counter may be stored at predetermined time interval, for example, once a day or week. The information may be stored using method that do not allow altering the data afterwards. Storing may be done to a memory on the electronic information plate. The memory may be of write-once type so that the data is difficult to alter. Storing data on the electronic information plate is beneficial in cases where the elevator has only limited or no data communication channel. For example, the elevator may be situated in a location where only expensive data communication channels are available and the operator is willing to reduce costs. In another embodiment the data is continuously stored into a cloud, central computer, server or similar computing device.

In another embodiment the use of an elevator may be prevented by the controller after predetermined number of unsuccessful automatic reading attempts. Thus, the electronic information plate cannot just be removed when trying to hide a fraud. The prevention of use may be conditional to an approval from a maintenance person. The use of elevator needs not to be prevented when the problem is in the electronic information plate or reader device.

As stated above, the components of the exemplary embodiments can include computer readable medium or memories for holding instructions programmed according to the teachings of the present embodiments and for holding data structures, tables, records, and/or other data described herein. Computer readable medium can include any suitable medium that participates in providing instructions to a processor for execution. Common forms of computer-readable media can include, for example, a floppy disk, a flexible disk, hard disk, magnetic tape, any other suitable magnetic medium, a CD-ROM, CD±R, CD±RW, DVD, DVD-RAM, DVD±RW, DVD±R, HD DVD, HD DVD-R, HD DVD-RW, HD DVD-RAM, Blu-ray Disc, any other suitable optical medium, a RAM, a PROM, an EPROM, a FLASH-EPROM, any other suitable memory chip or cartridge or any other suitable medium from which a computer can read.

It is obvious to a person skilled in the art that with the advancement of technology, the basic idea of the electronic information plate may be implemented in various ways. The electronic information plate and its embodiments are thus not limited to the examples described above; instead they may vary within the scope of the claims.

The invention claimed is:

1. A method for determining safety related properties of at least one component of an elevator, the method comprising:

reading an electronic information plate, wherein said electronic information plate is configured to store safety related information of at least one component of said elevator;

transmitting the content of said read electronic information plate into an elevator controller;

comparing said content with data associated with said elevator; and detecting as a result of said comparison if any of said at least one component has exceeded a predetermined life cycle, wherein said predetermined life cycle is counted in number of operation cycles or as a time interval.

2. A method according to claim 1, wherein reading said electronic information plate by using a reader fixed into an elevator car.

3. A method according to claim 1, wherein transmitting said content by using a transmitter of an elevator car.

4. A method according to claim 1, wherein the method further comprises receiving said content at said elevator controller and performing said comparing at said controller.

5. A method according to claim 1, wherein said at least one component of an elevator is a mechanical non-electronic component.

6. A method according to claim 1, wherein storing at least portion of said data associated with said elevator into at least one of the following: said electronic information plate, server, cloud or database.

7. An elevator comprising:

at least one component;

at least one electronic information plate associated with at least one component, wherein said at least one electronic information plate is configured to store safety related information with regard said associated at least one component; and a reader device for reading the content of said at least one electronic information plate.

8. The elevator according to claim 7, wherein said elevator further comprises a transmitter for transmitting said content.

9. The elevator according to claim 7, wherein said elevator comprises a controller and said controller is configured to receive said transmitted content.

10. The elevator according to claim 9, wherein said controller is configured to compare said content with data associated with said elevator.

11. The elevator according to claim 10, wherein said controller is configured to detect as a result of said comparison if any of said at least one component has exceeded a predetermined life cycle.

12. The elevator according to claim 7, wherein said controller is configured to store at least portion of said data associated with said elevator into at least one of the following: said electronic information plate, server, cloud or database.

13. The system according to claim 7, wherein said at least one electronic information plate comprises a security circuit.

14. The system according to claim 7, wherein said at least on electronic information plate is associated with at least one non-electronic component.

15. An electronic information plate, said electronic information plate being associated with a non-electronic elevator component, comprising:

at least one memory, wherein said at least one memory comprises information regarding at least one property of an elevator component;

at least one electricity source, wherein said electricity source is configured to receive electricity by using electromagnetic induction;

at least one communication interface, wherein said communication interface is configured to transmit said information regarding the at least one property of an elevator component as a response to read request; and at least one security circuit, wherein in said security circuit is configured to provide information necessary to verify the authenticity of said electronic information plate.

* * * * *